US007303410B2

(12) United States Patent
Saito

(10) Patent No.: US 7,303,410 B2
(45) Date of Patent: Dec. 4, 2007

(54) CONNECTOR IN WHICH A BALANCE IN PHYSICAL DISTANCE BETWEEN A GROUND CONTACT AND A PAIR OF SIGNAL CONTACTS CAN BE MAINTAINED

(75) Inventor: Yuichi Saito, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/647,090

(22) Filed: Dec. 28, 2006

(65) Prior Publication Data

US 2007/0149058 A1 Jun. 28, 2007

(30) Foreign Application Priority Data

Dec. 28, 2005 (JP) ..... 2005-379511

(51) Int. Cl.
*H01R 13/648* (2006.01)

(52) U.S. Cl. ..... 439/108; 469/79; 469/608

(58) Field of Classification Search ..... 439/108, 439/608, 610, 941
See application file for complete search history.

(56) References Cited

U.S. PATENT DOCUMENTS 5,525,067 A * 6/1996 Gatti ..... 439/108
5,685,739 A * 11/1997 Davis et al. ..... 439/607
5,902,147 A * 5/1999 Jochen et al. ..... 439/497
6,350,134 B1 * 2/2002 Fogg et al. ..... 439/79
6,494,734 B1 * 12/2002 Shuey ..... 439/378
6,540,559 B1 * 4/2003 Kemmick et al. ..... 439/608
6,692,272 B2 * 2/2004 Lemke et al. ..... 439/108
6,863,549 B2 * 3/2005 Brunker et al. ..... 439/108
6,953,351 B2 * 10/2005 Fromm et al. ..... 439/101
6,969,268 B2 * 11/2005 Brunker et al. ..... 439/108
7,165,981 B2 * 1/2007 Bassler et al. ..... 439/101
7,229,318 B2 * 6/2007 Winings et al. ..... 439/608
2002/0123254 A1 9/2002 Kato et al.
2006/0141866 A1 * 6/2006 Shiu ..... 439/608

FOREIGN PATENT DOCUMENTS

JP 2002334748 11/2002

* cited by examiner

*Primary Examiner*—Briggitte R. Hammond
*Assistant Examiner*—Larisa Tsukerman
(74) *Attorney, Agent, or Firm*—Collard & Roe, P.C.

(57) ABSTRACT

In a connector having a contacting portion side and a terminal portion side, a plurality of contact members are held by a housing to form on the contacting portion side a single row and forming on the terminal portion side two opposite end rows and a center row between the opposite end rows. The contact members are divided into a plurality of sets. Each of the sets includes a ground contact and a pair of signal contacts. On the single row, the ground contact and the signal contacts of each of the sets are successively arranged in this order. On the center row, the ground contact of each of the sets is placed. On one of the opposite rows, the signal contacts of a particular one of the sets are arranged. On another of the opposite rows, the signal contacts of a specific one of the sets are arranged.

7 Claims, 5 Drawing Sheets

CONNECTOR IN WHICH A BALANCE IN PHYSICAL DISTANCE BETWEEN A GROUND CONTACT AND A PAIR OF SIGNAL CONTACTS CAN BE MAINTAINED

This application claims priority to prior Japanese patent application JP 2005-379511, the disclosure of which is incorporated herein by reference.

BACKGROUND OF THE INVENTION

This invention relates to a connector capable of transmitting high-speed differential signals.

A connector of the type is used as an interface connector or an internal connector of a digital appliance or a PC. Such connector includes a plurality of signal contacts and a plurality of ground contacts. The signal contacts are paired in order to transmit differential signals in the manner known in the art. Generally, on the side of a fitting portion or a contacting portion side of the connector to be fitted to or contacted with a mating connector, the signal contacts and the ground contacts are arranged in a single row. On the other hand, on the terminal portion side of the contacts to be connected to a board, the terminal portions are arranged in a plurality of rows because the terminal portions are inserted into a plurality of through holes, respectively. Thus, so-called pitch conversion is performed between the contacting portions and the terminal portions of the contacts.

For example, in a connector disclosed in Japanese Unexamined Patent Application Publication No. 2002-334748 (JP 2002-334748 A), the contacting portions are arranged so that a plurality of sets of one ground contact (G) and two signal contacts (S) as paired signal contacts are alternately consecutively arranged (G, S, S, G, S, S, . . . ). In this event, in case of normal pitch conversion, an imbalance is caused in physical distance between the ground contact and the paired signal contacts on the side of the terminal portions.

As a result, the connector may be deteriorated in transmission characteristics so that a performance for high-speed transmission can not be satisfied.

SUMMARY OF THE INVENTION

It is therefore an object of this invention to provide a connector which is improved in transmission characteristics by maintaining a balance in physical distance between a ground contact and a pair of signal contacts when the connector is mounted to a board.

It is another object of this invention to provide a connector suitable for transmission of a video signal requiring high-speed transmission.

Other objects of the present invention will become clear as the description proceeds.

According to an aspect of the present invention, there is provided a connector having a contacting portion side to be connected to a mating connector and a terminal portion side to be connected to a connection object, the connector comprising a plurality of contact members forming on the contacting portion side a single row and forming on the terminal portion side two opposite rows and a center row between the opposite rows and a housing holding the contacts, the contact members being divided into a plurality of sets, each of the sets comprising a ground contact and a pair of signal contacts, on the single row, the ground contact and the signal contacts of each of the sets being successively arranged in this order, on the center row, the ground contact of each of the sets being placed, on one of the opposite rows, the signal contacts of a particular one of the sets being arranged, on another of the opposite rows, the signal contacts of a specific one of the sets being arranged.

DESCRIPTION OF THE PREFERRED EMBODIMENT

Figure 1A:
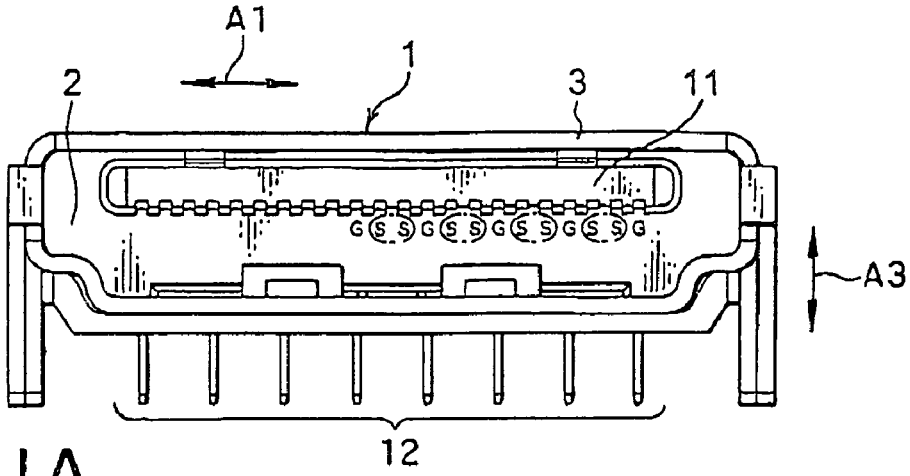
FIG. 1A is a front view of a connector according to an embodiment of this invention.
Figure 1B:
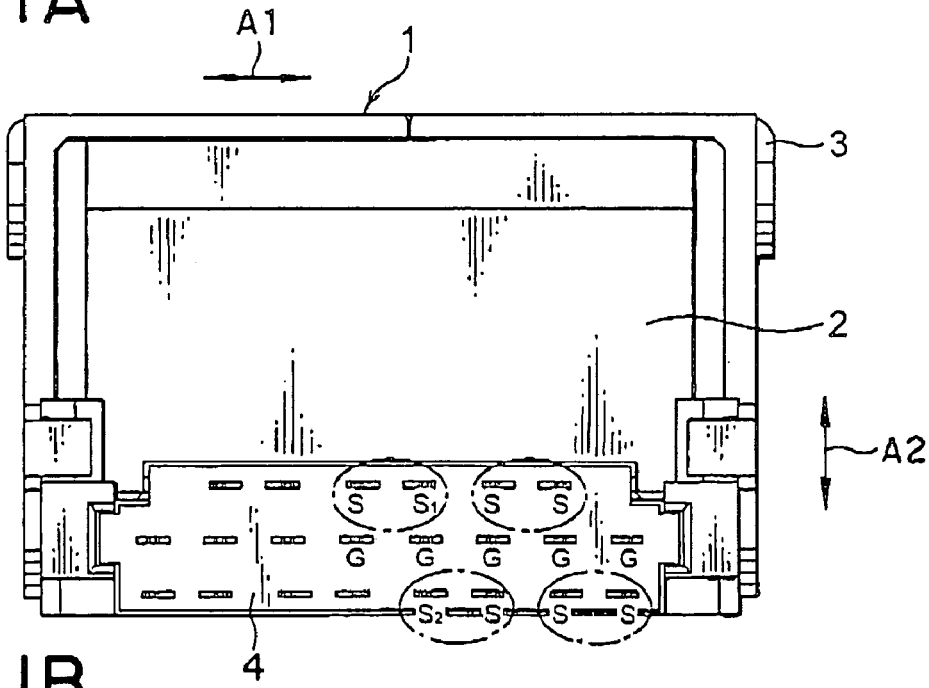
FIG. 1B is a bottom view of the connector in FIG. 1A.
Figure 1C:
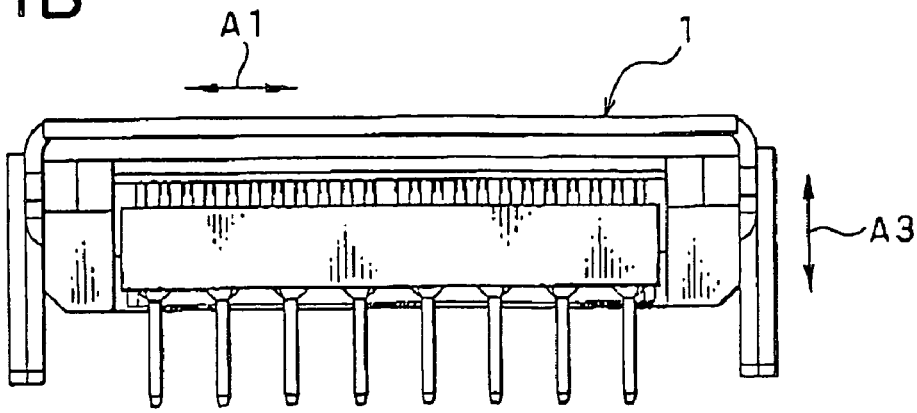
FIG. 1C is a rear view of the connector in FIG. 1A.
Figure 2:
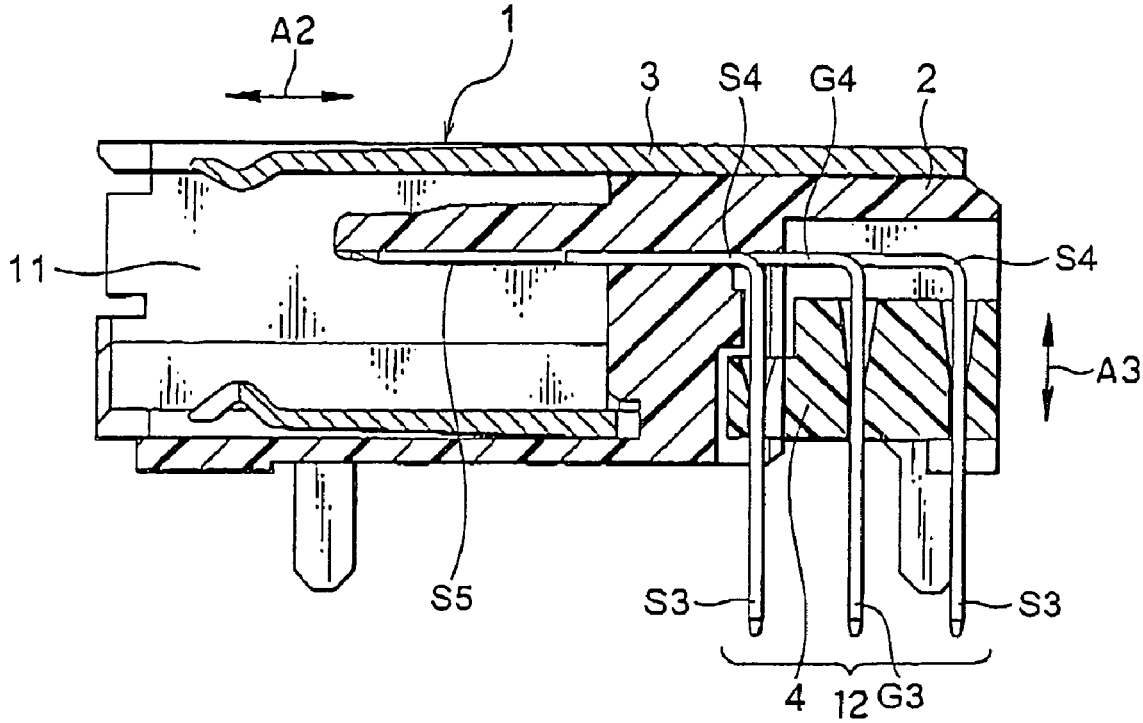
FIG. 2 is an enlarged sectional side view of the connector illustrated in FIGS. 1A to 1C.

Referring to FIGS. 1A to 2, description will be made of a high-speed transmission interface board connector (hereinafter will simply be called a board connector) as a connector according to one embodiment of this invention.

The board connector is depicted at a reference numeral 1 and has a fitting portion 11 on a contacting portion side (left side in FIG. 2) to be connected to a mating connector and a board connecting portion 12 on a terminal portion side (right side in FIG. 2) to be connected to a connection object. The board connector 1 includes an insulating housing 2 and a conductive shell 3 attached to the housing 2 so as to cover the fitting portion 11 and the housing 2.

The housing 2 holds a plurality of contact members divided into a plurality of sets. Each of the sets of the contact members comprises a pair of conductive signal contacts (which are surrounded by a chain circle for convenience) S and a conductive ground contact G adjacent to the signal contact pair. The signal contacts S are 14 in number. The ground contacts G are 8 in number.

One of the signal contacts of the pair is assigned to a first signal included in paired differential signals known in the art. Another of the signal contacts of the pair is assigned to a second signal included in the paired differential signals. It is a matter of course that the ground contacts are connected to the ground.

The signal contacts S and the ground contacts G have contacting portions arranged on the contacting portion side in a single row extending in a first direction A1. In other words, a combination of the contacting portions of the signal contacts S and the ground contacts G forms the single row in the fitting portion 11.

On the other hand, the signal contacts S and the ground contacts G have terminal portions arranged on the contacting portion side in three rows which are arranged in a second direction A2 perpendicular to the first direction A1 and each of which extends in the first direction A1. In other words, a combination of the terminal portions of the signal contacts S and the ground contacts G forms the three rows in the board connecting portion 12. It should be noted that three rows of the terminal portions are parallel to one another and are referred to opposite end rows and a center row between the opposite end rows.

Each of the signal contacts S has a generally L shape and is formed to have a terminal portion S3 extending in a third direction A3 perpendicular to the first and the second directions A1 and A2, a generally right-angled portion S4 extended from the terminal portion S3, and a contacting portion S5 extended from the generally right-angled portion S4 in the second direction A2. On the other hand, each ground contact G has a generally L shape and is formed to have a terminal portion G3 extending in the third direction A3, a generally right-angled portion G4 extended from the terminal portion G3, and a contacting portion G5 (see FIG. 3) extended from the generally right-angled portion G4 in the second direction A2.

The board connector further comprises a location plate 4 fitted in the housing 2 and fixed thereto. The signal contacts S and the ground contacts G are engaged with the location plate 4 in the manner which will later be described.

Figure 3:
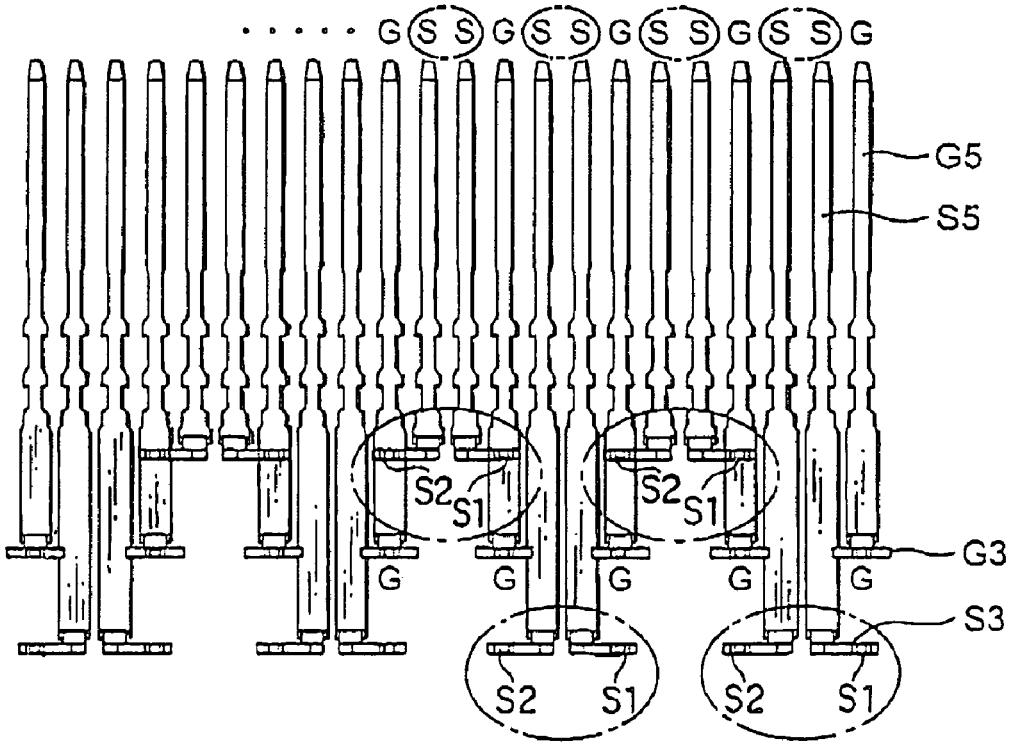
FIG. 3 is a bottom view of a contact group of the connector illustrated in FIGS. 1A to 1C.
Figure 4:
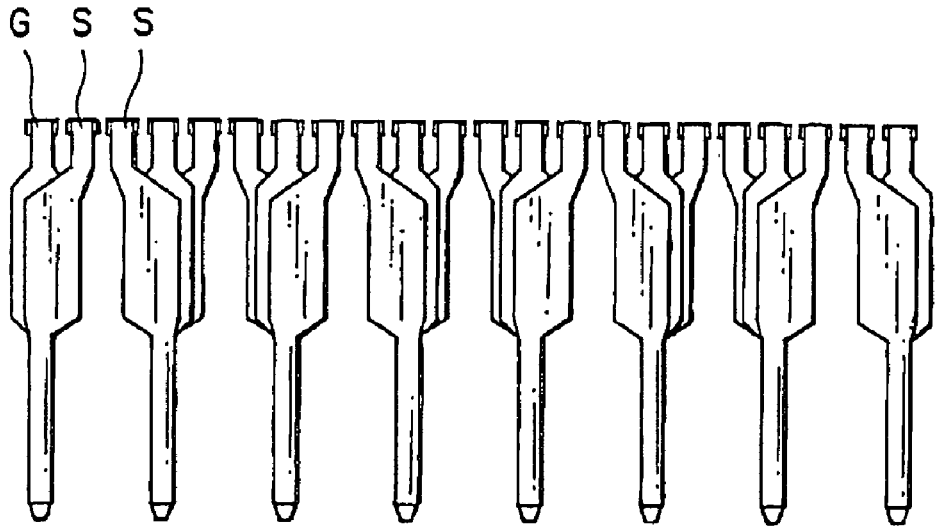
FIG. 4 is a rear view of the contact group illustrated in FIG. 3.

Referring to FIGS. 3 and 4 in addition, the description will be directed to the terminal portion side. Herein, the signal contacts S of the pair will collectively be called a differential signal contact pair.

In the terminal portion side, the ground contacts G are arranged in the center row while the signal contacts S are arranged in the opposite end rows. In addition, the differential signal contact pair is placed on either of the opposite end rows so that the signal contacts S are adjacent to one another. In this arrangement, a right-side contact S1 of each of the differential signal contact pairs arranged in one of the opposite end rows is faced to a left-side contact S2 of each of the differential signal contact pairs arranged in another of the opposite end rows. Each of the ground contacts G is interposed between the right-side contact S1 and the left-side contact S2 of adjacent ones of the differential signal contact pairs.

The pitch of the signal contacts S in the board connecting portion 12 is three times of the pitch of the signal contacts S in the fitting portion 11. It is noted here that the pitch of the signal contacts S in the board connecting portion 12 may be greater or smaller than three times that of the signal contacts S in the fitting portion 11. Namely, it is possible to determine the pitch of the signal contacts S in response to the needs of the connection object. On the other hand, the ground contacts G extend without being performed with such pitch conversion.

Figure 5:
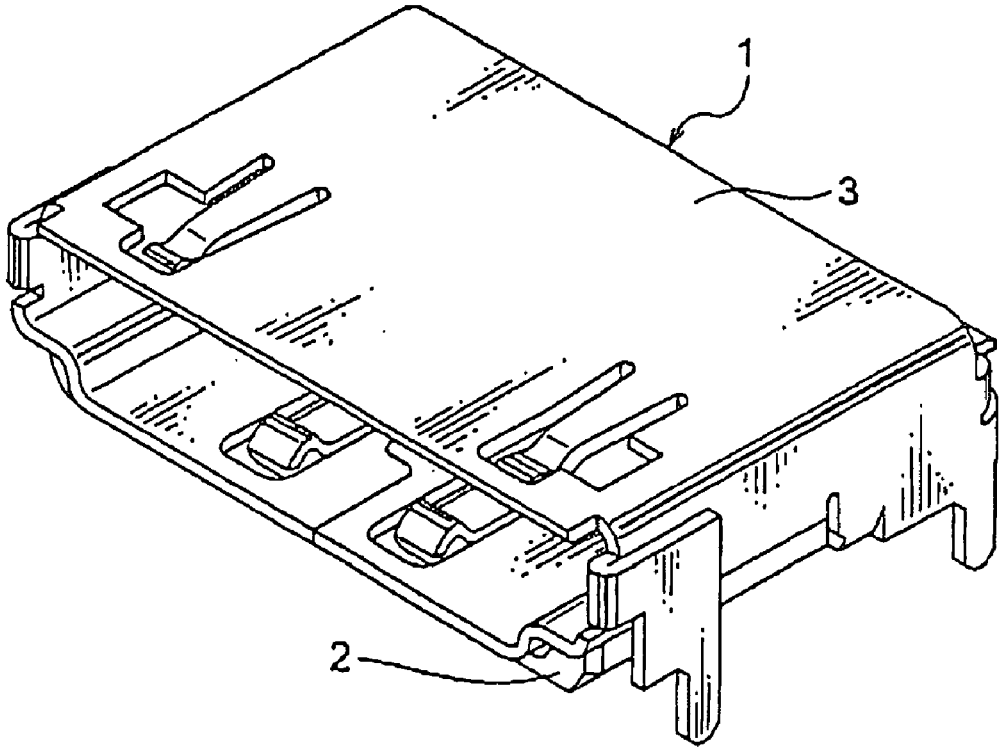
FIG. 5 is a perspective view of the connector illustrated in FIGS. 1A to 1C.

In addition, the signal contacts S and the ground contacts G extend to pass through a plurality of through holes of the location plate 4. Thus, the signal contacts S and the ground contacts G are positioned by the location plate 4. Such structure of the board connector will also be understood from FIGS. 5 and 6.

Figure 6:
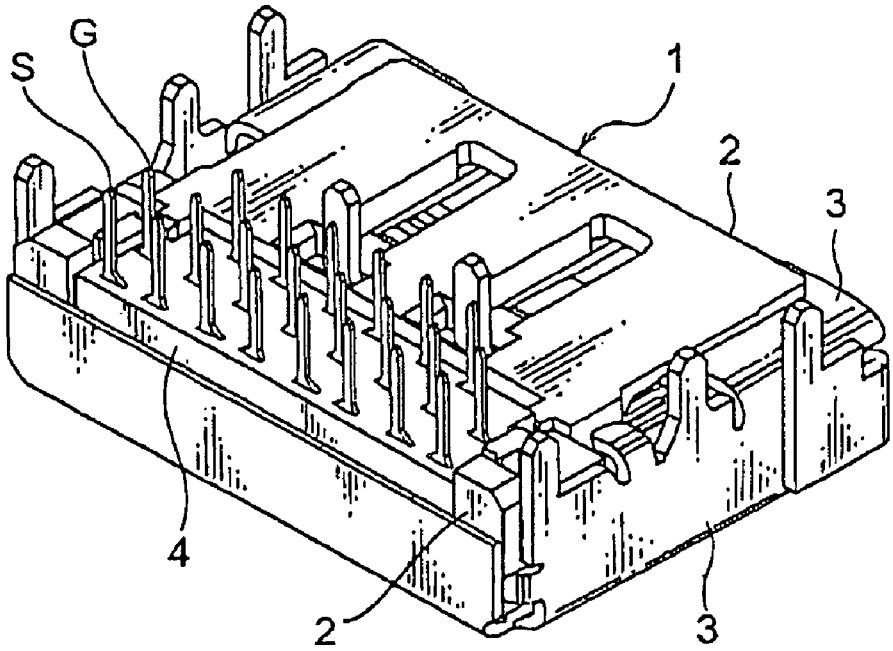
FIG. 6 is a perspective view of the connector illustrated in FIGS. 1A to 1C as seen in a different direction.
Figure 7:
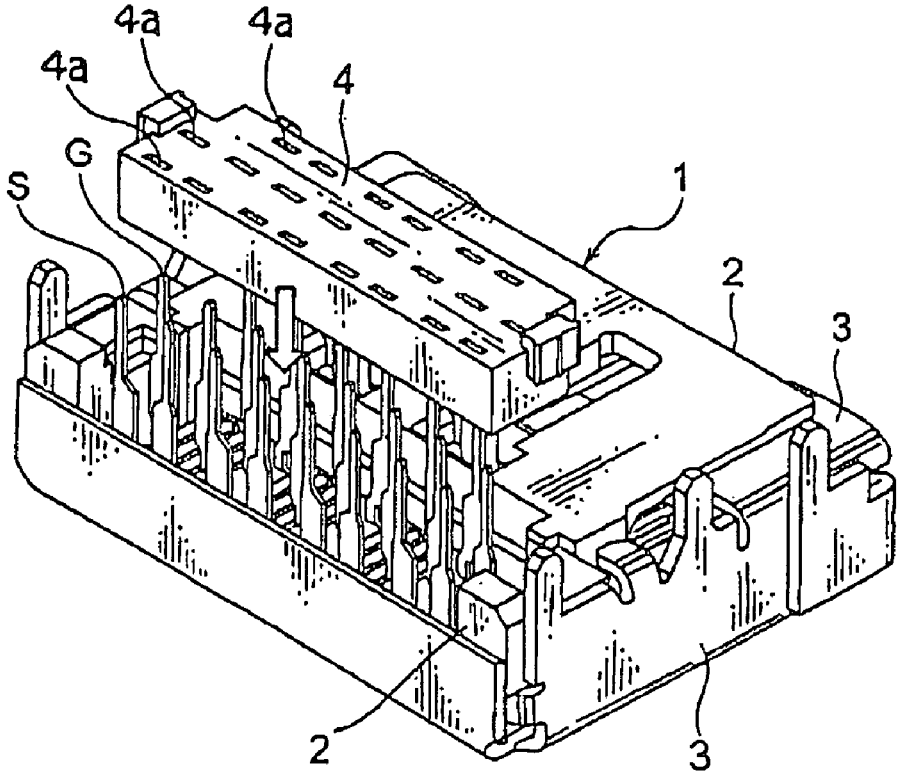
FIG. 7 is a perspective view similar to FIG. 6 in a state where the connector is partially exploded.

Referring to FIG. 7 in addition, the description will be directed to the location plate 4. The location plate 4 serves to align the signal contacts S and the ground contacts G and to prevent excessive deformation of the signal contacts S and the ground contacts G. After the signal contacts S and the ground contacts G are press-fitted to the housing 2, a plurality of through holes 4*a* of the location plate 4 are aligned with the signal contacts S and the ground contacts G as shown in FIG. 7. Then, as shown in FIG. 6, the location plate 4 is fitted to the housing 2. Thus, the board connector 1 is assembled.

In the board connector 1 thus assembled, the paired differential signal contacts are equivalent in positional relationship or distance relationship with respect to the ground contact. It is therefore possible to assure excellent transmission characteristics with impedance matching and with reduction in crosstalk. The board connector 1 may be used as an interface connector or an internal connector of a digital appliance or a PC.

Figure 8:
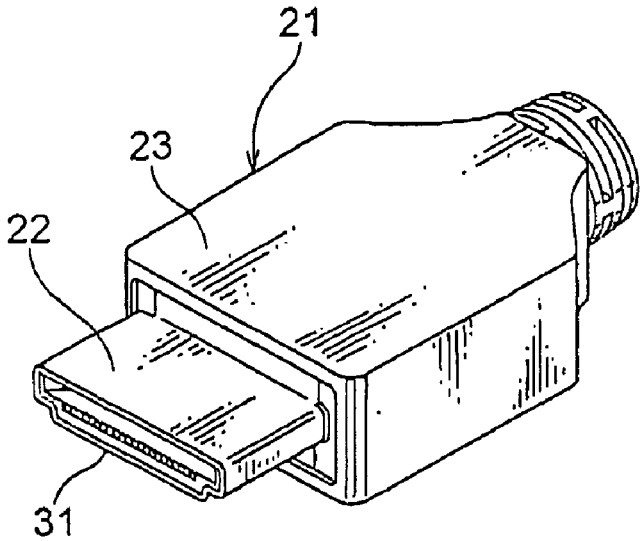
FIG. 8 is a perspective view of a mating connector to be fitted to the connector in FIGS. 1A to 1C.

FIG. 8 shows a cable connector 21 to be fitted to the board connector 1. The cable connector 21 has a fitting portion 31 covered with a shell 22. The cable connector 21 is surrounded by a hood 23 except the fitting portion 31 covered with the shell 22.

Figure 9:
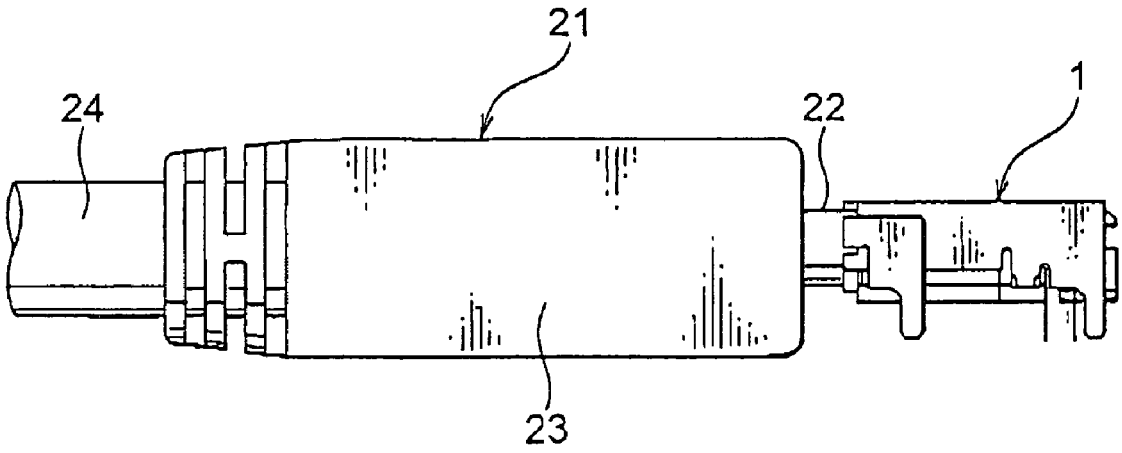
FIG. 9 is a right side view showing a state where the connector and the mating connector are fitted to each other.

FIG. 9 shows a state where the board connector 1 and the cable connector 21 are fitted to each other. A cable 24 is connected to the left side of the cable connector 21.

While the present invention has thus far been described in connection with the preferred embodiment thereof, it will readily be possible for those skilled in the art to put this invention into practice in various other manners. For example, on the terminal portion side of the board connector, signal contacts, ground contacts, power supply contacts, or the like other than the differential signal contact pairs may be disposed. Further, this invention is applicable not only the high-speed transmission interface connector but also other various types of connectors.

What is claimed is:

1. A connector having a contacting portion side to be connected to a mating connector and a terminal portion side to be connected to a connection object, the connector comprising:

a plurality of contact members forming on the contacting portion side a single row and forming on the terminal portion side two opposite end rows and a center row between the opposite end rows; and a housing holding the contacts;

the contact members being divided into a plurality of sets, each of the sets comprising a ground contact and a pair of signal contacts;

on the single row, the ground contact and the signal contacts of each of the sets being successively arranged in this order;

on the center row, the ground contact of each of the sets being placed;

on one of the opposite end rows, the signal contacts of a particular one of the sets being arranged;

on another of the opposite end rows, the signal contacts of a different one of the sets being arranged.

2. The connector according to claim 1, wherein the particular and the specific ones are adjacent to each other in the single row.

3. The connector according to claim 1, further comprising a location plate disposed on the terminal portion side and coupled to the housing, the contact members being engaged with the location plate.

4. The connector according to claim 3, wherein the location plate has a plurality of through holes, the contact members being inserted through the through holes.

5. The connector according to claim 1, wherein the signal contacts of the pair comprise a first contact assigned to a first signal and a second contact assigned to a second signal, the first contacts in adjacent ones of the sets have on the terminal portion side a pitch which is three times of a pitch on the contacting portion side.

6. The connector according to claim 5, wherein the second contacts in adjacent ones of the sets have on the terminal portion side a pitch is three times of a pitch on the contacting portion side.

7. The connector according to claim 6, wherein the ground contacts have on the terminal portion side a pitch which is equal to a pitch on the contacting portion side.

* * * * *